US009750099B2

(12) United States Patent
Chen et al.

(10) Patent No.: US 9,750,099 B2
(45) Date of Patent: Aug. 29, 2017

(54) LIGHT EMITTING DEVICE WITH LOW VOLTAGE-ENDURANCE COMPONENTS

(71) Applicant: TM TECHNOLOGY, INC, Hsinchu (TW)

(72) Inventors: Kuo-Tso Chen, Taipei (TW); Chi-Cheng Chao, Kaohsiung (TW); Chih-Yueh Yen, Hsinchu County (TW)

(73) Assignee: TM TECHNOLOGY, INC, Hsinchu (TW)

( * ) Notice: Subject to any disclaimer, the term of this patent is extended or adjusted under 35 U.S.C. 154(b) by 0 days.

(21) Appl. No.: 15/186,268

(22) Filed: Jun. 17, 2016

(65) Prior Publication Data

US 2016/0374166 A1 Dec. 22, 2016

Related U.S. Application Data

(60) Provisional application No. 62/181,486, filed on Jun. 18, 2015.

(51) Int. Cl.
*H05B 37/02* (2006.01)
*H05B 33/08* (2006.01)

(52) U.S. Cl.
CPC ..... *H05B 33/083* (2013.01)

(58) Field of Classification Search
CPC ..... H05B 33/083; H05B 33/0848
USPC ..... 315/185 R, 291, 307, 308, 309
See application file for complete search history.

(56) References Cited

U.S. PATENT DOCUMENTS 8,174,212 B2 * 5/2012 Tziony ..... H05B 33/0815 315/122
8,471,495 B2 * 6/2013 Muguruma ..... H05B 33/0824 315/185 R
9,125,261 B2 * 9/2015 Reed ..... H05B 33/0815
9,144,127 B1 * 9/2015 Yu ..... H05B 33/0827
9,345,087 B2 * 5/2016 Yu ..... H05B 33/083

FOREIGN PATENT DOCUMENTS

TW 201112860 A1 4/2011
TW 201410064 A 3/2014

OTHER PUBLICATIONS

Taiwan Office Action for corresponding application No. TW105112657, mailed Jan. 5, 2017. (partial translation).

* cited by examiner

*Primary Examiner* — Thuy Vinh Tran
(74) *Attorney, Agent, or Firm* — Maschoff Brennan

(57) ABSTRACT

A light emitting device with low voltage-endurance components includes a light emitting diode string, M first control circuits, a detection unit and a current control circuit. The light emitting diode string includes M first light emitting diodes connected in series. Each first control circuit includes a first switch. One end of the light emitting string is coupled to a node of an input voltage. The first switch is connected to its related first light emitting diode in parallel and can enable a bypass current path. The detection unit detects the potential of the input voltage to produce a current detection signal. The current control circuit is coupled to the M-th one of the M first control circuits and the detection unit and controls the M-th one of the M first control circuits to selectively enable the bypass current path according to the current detection signal.

21 Claims, 10 Drawing Sheets

LIGHT EMITTING DEVICE WITH LOW VOLTAGE-ENDURANCE COMPONENTS

CROSS-REFERENCE TO RELATED APPLICATIONS

This non-provisional application claims priority under 35 U.S.C. §119(a) on Patent Application No. 62/181,486 filed in the United States on Jun. 18, 2015, the entire contents of which are hereby incorporated by reference.

BACKGROUND

Technical Field

The disclosure relates to a light emitting device, more particularly to a light emitting device emitting light via one or more light emitting diodes.

Related Art

Light emitting diodes (LED) are characterized by having a relatively-long lifespan, a relatively-small size, a relatively-good earthquake-resistant ability, relatively-low thermal production and relatively-low power consumption, so recently they have been used as indicators or light sources in a variety of equipment. Moreover, multicolor and high-brightness light emitting diodes are being developed and applied to larger outdoor billboards, traffic lights and relevant fields. In the future, it is very possible to use light emitting diodes as the main illumination light sources with power saving and environmental protection functions.

However, as a conventional light emitting device using a light emitting diode string to provide a light source, light emitting diodes in the light emitting diode string were typically turned on in a specific order, so components respectively corresponding to the light emitting diodes needed to bear a relatively-high voltage difference between their two ends. Therefore, these components in such a conventional light emitting device usually have high voltage-endurance. Also, since a high voltage-endurance component requires a relatively-low working current, the light emitting device would need more or larger high voltage-endurance components. This manner brought in the limitation in the circuit design and led to a higher manufacturing cost of the light emitting device.

SUMMARY

According to one or more embodiments, a light emitting device with one or more low voltage-endurance components includes a light emitting diode string, M first control circuits, a detection circuit and a current control circuit. The light emitting diode string includes M first light emitting diodes connected in series, and each first control circuit includes a first switch. One end of light emitting diode string is coupled to a node of an input voltage. The current control circuit is coupled to the M-th one of the M first control circuits and the detection circuit. The first switch is connected to the first light emitting diode corresponding to the first switch and is applicable to selectively enable a bypass current path. The detection circuit is applicable to detect a total current, flowing through one or more of the light emitting diodes and one or more switches respectively connected to the one or more of the light emitting diodes in parallel, to produce a current detection signal. The current control circuit, according to the current detection signal, controls the M-th one of the M first control circuits whether to provide a preset voltage to the first switch in the M-th one of the M first control circuits, so as to selectively enable the bypass current path. When the first switch in the M-th one of the M first control circuits does not enable the bypass current path, the M-th one of the M first control circuits further, in response to the potential of the input voltage, selectively controls the (M−1)th one of the M first control circuits to provide the preset voltage to the first switch in the (M−1)th one of the M first control circuits. M is a positive integer larger than 1.

In another embodiment, when the first switch in the i-th one of the M first control circuits does not enable the bypass current path, the i-th one of the M first control circuits, according to the total current, selectively controls the (i−1)th one of the M first control circuits to provide the preset voltage to the first switch in the (i−1)th one of the M first control circuits, and i is a positive integer larger than 1 but not larger than M. Moreover, the i-th one of the M first control circuits further includes a constant current source, a first resistor and a second switch. The constant current source has two ends respectively coupled to the node of the input voltage and a first node. The first resistor has two ends respectively coupled to the first node and a second node. The second switch is coupled to the first node and the first node of the (i−1)th one of the M first control circuits and is controlled by the potential of the second node to selectively enable the connection between the first node of the i-th one of the M first control circuits and the first node of the (i−1)th one of the M first control circuits. In addition, when the potential of the second node of the i-th one of the M first control circuits is higher than a related threshold, the second switch in the i-th one of the M first control circuits is turned on and the current control circuit, in response to the current detection signal, causes that the output current of the constant current source in the (i−1)th one of the M first control circuits flows to the current control circuit after flowing through the second switch in the i-th one of the M first control circuits.

According to an embodiment, a light emitting device with one or more low voltage-endurance components includes a light emitting diode string and M first control circuits. The light emitting diode string includes M first light emitting diodes, a second light emitting diode and a third light emitting diode. Each first control circuit includes a first switch. The M first light emitting diodes are connected in series in an order, the second light emitting diode is coupled to the M-th one of the M first light emitting diodes, and the third light emitting diode has two ends respectively coupled to the first one of the M first light emitting diodes and a node of an input voltage. The first switch is connected to the corresponding first light emitting diode and selectively enables a bypass current path with accordance to the control of the first control circuit. When the input voltage is larger than a first threshold, the second light emitting diode and the third light emitting diode emit light according to a current caused by the input voltage. When the input voltage is larger than a second threshold larger than the first threshold, the M first control circuits selectively enable M bypass current paths. M is a positive integer larger than 1.

In another embodiment, the light emitting device further includes a detection circuit and a current control circuit. The detection circuit detects a total current, flowing through one or more of the light emitting diodes and one or more switches connected to the one or more light emitting diodes in parallel to produce a current detection signal. The current control circuit is coupled to the M-th one of the M first control circuits and the detection circuit. The current control circuit, according to the current detection signal, controls the M-th one of the M first control circuits whether or not to turn on the first switch in the M-th one of the M first control circuits, so as to selectively enable the bypass current path. Moreover, when the first switch in the i-th one of the M first control circuits does not enable the bypass current path, the i-th one of the M first control circuits, according to the potential of the input voltage, selectively controls the (i−1)th one of the M first control circuits to provide the preset voltage to the first switch in the (i−1)th one of the M first control circuits, and i is a positive integer larger than 1 but not larger than M. The i-th one of the M first control circuits further includes a constant current source, a first resistor and a second switch. The two ends of the constant current source are respectively coupled to the node of the input voltage and a first node. The two ends of the first resistor are respectively coupled to the first node and a second node. The second switch is coupled to the first node of the i-th one of the M first control circuits and the first node of the (i−1)th one of the M first control circuits and is controlled by the potential of the second node to selectively enable the connection between the first node of the i-th one of the M first control circuits and the first node of the (i−1)th one of the M first control circuits to selectively form a branch path. When the potential of the second node of the i-th one of the M first control circuits, provided by the division of the input voltage, is larger than a related threshold, the i-th one of the M first control circuits turns on a related branch path, and the current control circuit, according to the current detection signal, causes that the output current of the (i−1)th one of the M first control circuits flows to the (i−1)th branch path.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
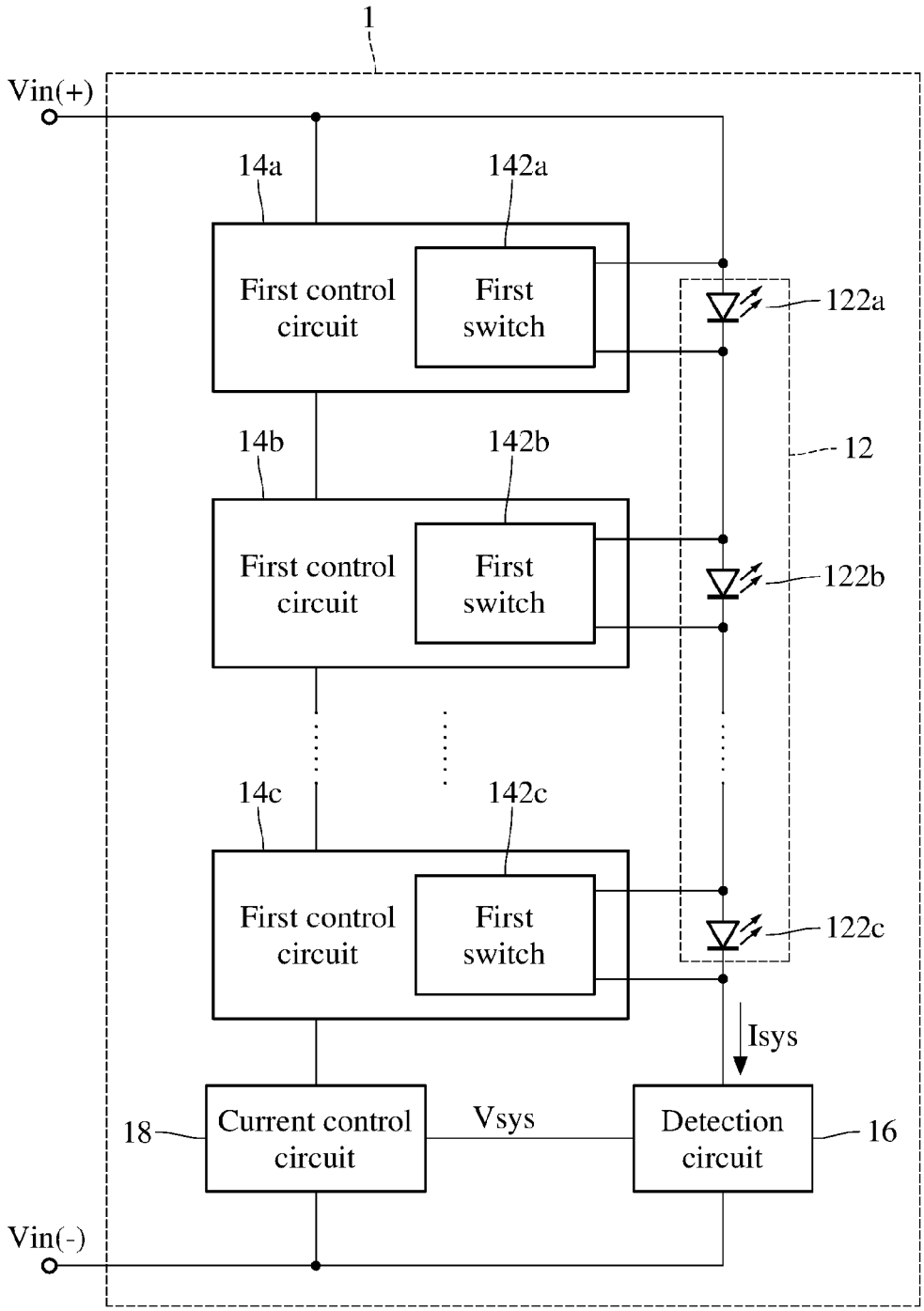
FIG. 1 is a functional block diagram of a light emitting device in an embodiment of the disclosure.

Please refer to FIG. 1. FIG. 1 is a functional block diagram of a light emitting device in an embodiment of the disclosure. As shown in the figure, a light emitting device 1 with one or more low voltage-endurance components includes a light emitting diode string 12, a plurality of first control circuits 14*a*~14*c*, a detection circuit 16 and a current control circuit 18. The light emitting diode string 12 includes first light emitting diodes 122*a*~122*c* connected in series. The first control circuits 14*a*~14*c* respectively include first switches 142*a*~142*c*. One end of the light emitting diode string 12 is coupled to a node of an input voltage Vin. The first switches 142*a*~142*c* are connected to the first light emitting diodes 122*a*~122*c* in parallel, respectively. The current control circuit 18 is coupled to the first control circuit 14*c* and the detection circuit 16. In practice, the light emitting device 1 could include M first light emitting diodes and M first control circuits respectively corresponding to the M first light emitting diodes, and M is a positive integer larger than 1. For a concise description, the first light emitting diodes 122*a*~122*c* are exemplified to explain the disclosure, and however, the amount of first light emitting diodes is not limited thereto.

The first control circuits 14*a*~14*c* are applicable to selectively enable one or more bypass current paths for one or more of the first light emitting diodes 122*a*~122*c*. Particularly, one or more of the first control circuits 14*a*~14*c* provide a preset voltage to one or more of the first switches 142*a*~142*c*, and if one of the first switches 142*a*~142*c* receives the preset voltage, this first switch is turned on so that a related bypass current path is formed. In the figure, the first switches 142*a*~142*c* are respectively connected to the first light emitting diodes 122*a*~122*c* in parallel, and when one or more of the first switches 142*a*~142*c* are turned on, a current will flow through one or more related bypass current paths instead of flowing through corresponding one or more of the first light emitting diodes 122*a*~122*c*. Therefore, the one or more first light emitting diodes through which the current does not flow will not emit light.

The detection circuit 16 is applicable to detect a total current Isys that flows through one or more light emitting diodes and one or more corresponding switches, to produce a current detection signal Vsys. In this embodiment, the detection circuit 16, according to the current Isys, produces the current detection signal Vsys. For example, the detection circuit 16 is a resistor, the current Isys is a current flowing through the light emitting diode string 12, and the current detection signal Vsys is a voltage signal produced when the current Isys flows through the detection circuit 16. In practice, a person of ordinary skill in the art can, in view of the disclosure, design the detection manner of the detection circuit 16 or replace the voltage type of the current detection signal Vsys by the current type or other types of the current detection signal Vsys according to actual requirements, and the disclosure has no limitation in these possible changes.

The current control circuit 18 is applicable to in response to the current detection signal Vsys, control the first control circuit 14*c* whether to provide the preset voltage to the first switch 142*c*, so as to selectively turn on the first switch 142*c* to enable the related bypass current path.

If the first control circuit 14*c* controls the first switch 142*c* not to enable the related bypass current path, the first control circuit 14*c*, according to the potential of the input voltage Vin, selectively controls the first control circuit 14*b* to provide a preset voltage to the first switch 142*b*, so as to selectively enable a related bypass current path. More particularly, when the input voltage Vin is larger than its related threshold, the first control circuit 14*c* will control the first control circuit 14*b* to turn off the first switch 142*b*, so the related bypass current path will not be enabled. As described above, since the current flows through the first light emitting diode 122*b*, the first light emitting diode 122*b* emits light.

Likewise, when the first switch 142*b* in the first control circuit 14*b* does not enable its related bypass current path, the first control circuit 14*b*, according to the potential of the input voltage Vin, selectively controls the first control circuit 14*a* to provide a preset voltage to the first switch 142*a*. A person of ordinary skill in the art can understand that in the case of the light emitting device 1 including the M first control circuits and the M first light emitting diodes, when the i-th one of the M first control circuits does not enable its related bypass current path, the i-th one of the M first control circuits will, according to the potential of the input voltage Vin, selectively control the (i−1)th one of the M first control circuits to enable its related bypass current path, where i is a positive integer larger than 1 but not larger than M.

Figure 2:
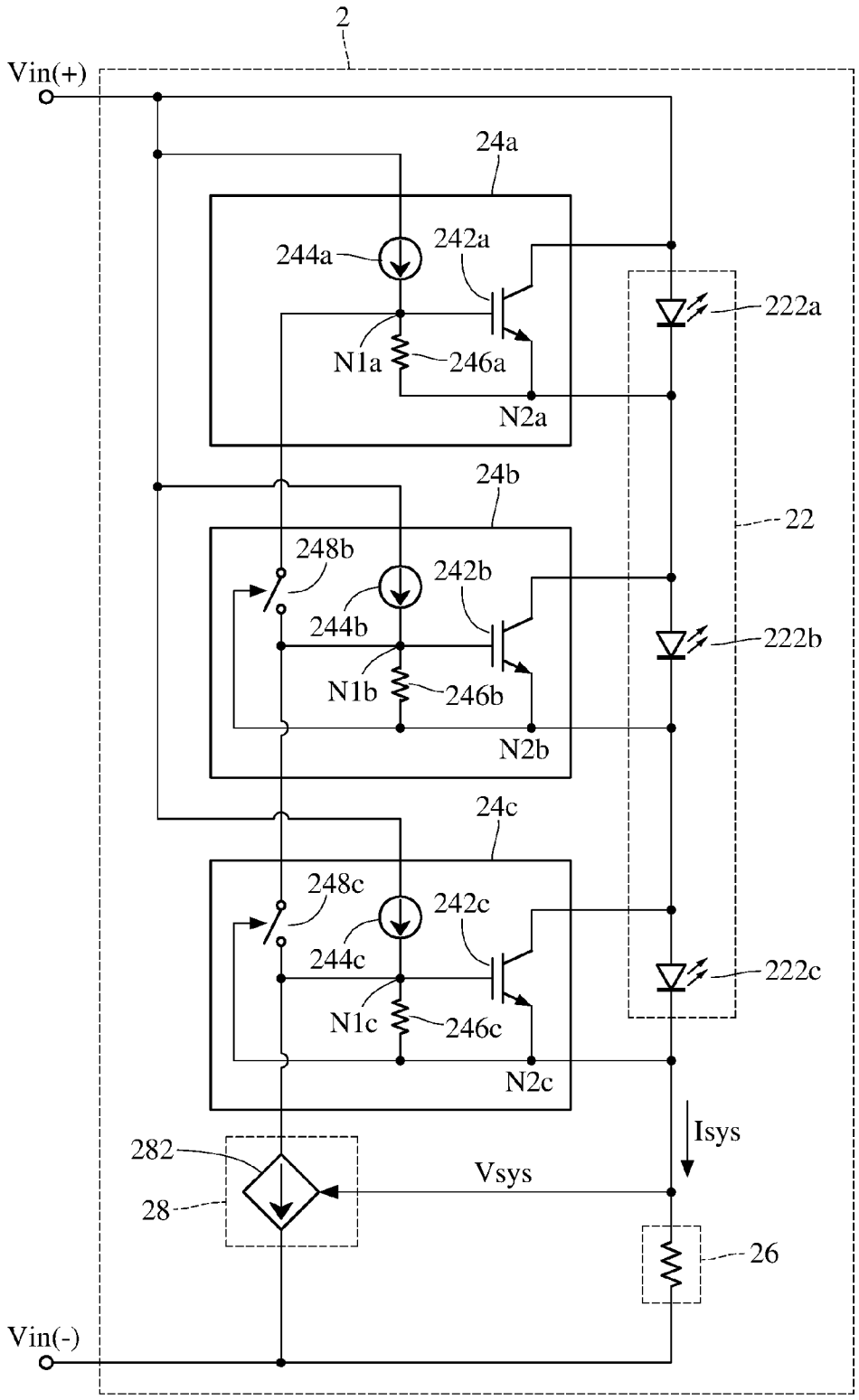
FIG. 2 is schematic circuit diagram of the light emitting device in an embodiment of the disclosure.

Please refer to FIG. 2 to introduce the circuit of the light emitting device more detailed. FIG. 2 is schematic circuit diagram of the light emitting device in an embodiment of the disclosure. As shown in FIG. 2, in a light emitting device 2 with one or more low voltage-endurance components, each of the first control circuits 24*a*~24*c* further includes more elements. In the case of the first control circuit 24*c*, the first control circuit 24*c* further includes a constant current source 244*c*, a first resistor 246*c* and a second switch 248*c*. In this embodiment, the current control circuit 28 includes a voltage-controlled current source 282.

The constant current source 244*c* has two ends respectively coupled to the node of the input voltage Vin and a first node N1*c*. The two ends of the first resistor 246*c* are respectively coupled to the first node N1*c* and the second node N2*c*. The second switch 248*c* is coupled to the first node N1*c* and the first node N1*b* of the first control circuit 24*b*. The second switch 248*c* is controlled by the potential of the second node N2*c* to selectively enable the connection between the first node N1*c* and the first node N1*c*, so as to selectively enable a related branch path. The potential of the second node N2*c* is a division of the input voltage Vin to the second node N2*c*.

The two ends of the first switch 242*c* are electrically connected to the second node N2*c* and the second node N2*b* of the first control circuit 24*b*, respectively, and the control end of the first switch 242*c* is coupled to the first node N1*c*. In the figure, the cathode end of the first light emitting diode 222*c* is coupled to the second node N2*c*, and the anode end of the first light emitting diode 222*c* is coupled to the second node N2*b*. Therefore, the first switch 242*c* is controlled by the potential of the first node N1*c* to selectively enable the bypass current path between the second node N2*c* and the second node N2*b*.

In the embodiment shown in FIG. 2, the first light emitting diodes 222*a*~222*c* respectively have their own thresholds. When the input voltage Vin is larger than a threshold corresponding to one of the first light emitting diodes 222*a*~222*c*, the corresponding one of the first light emitting diodes 222*a*~222*c* will be driven to emit light. Moreover, the thresholds respectively corresponding to the first light emitting diodes 222*a*~222*c* are set from the largest one to the smallest one. Therefore, with the increase of the input voltage Vin, the first one to be turned on is the first light emitting diode 222*c*, the second one is the first light emitting diode 222*b*, and the last one is the first light emitting diode 222*a*.

More particularly, when a division of the input voltage Vin to the second node N2*c* is larger than a related threshold, the first control circuit 24*c* enables a related branch path and the current control circuit 28 correspondingly increases the current value of the control current Icon according to the current detection signal Vsys, so the output current of the first control circuit 24*b*, i.e. the output current of the constant current source 244*b*, flows to the branch path in the first control circuit 24*c*. Therefore, the first switch 242*b* is turned off, and the first light emitting diode 222*b* then emits light. When the first control circuit 24*c* does not enable its related branch path, the output current of the constant current source 244*b* in the first control circuit 24*b* flows through the first resistor 246*b* to provide a preset voltage to the first node N1*b*, so the first switch 242*b* is turned on to enable its related bypass current path. Therefore, the first light emitting diode 222*b* does not emit light.

In other words, when the potential of the input voltage Vin successively increases, the first control circuit 24*c*, according to the input voltage Vin and the control current Icon, selectively provides a related bypass current path and the first control circuits 24*c* and 24*b* also enable their related branch paths in turn according to the input voltage Vin. Meanwhile, the current control circuit 28 correspondingly increases the current value of the control current Icon on the related branch path, so as to enable the first light emitting diode 222*b* or 222*a*. Similarly, when the potential of the input voltage Vin successively decreases, the first control circuits 24*b* and 24*c* cut off their related branch paths in turn according to the input voltage Vin and the current control circuit 28 correspondingly decreases the current value of the control current Icon. Therefore, the first light emitting diodes 222*a* and 222*b* are turned off in turn. Finally, the first control circuit 24*c*, according to the input voltage Vin and the control current Icon, provides the related bypass current path so that the first light emitting diode 222*c* is turned off.

Figure 3:
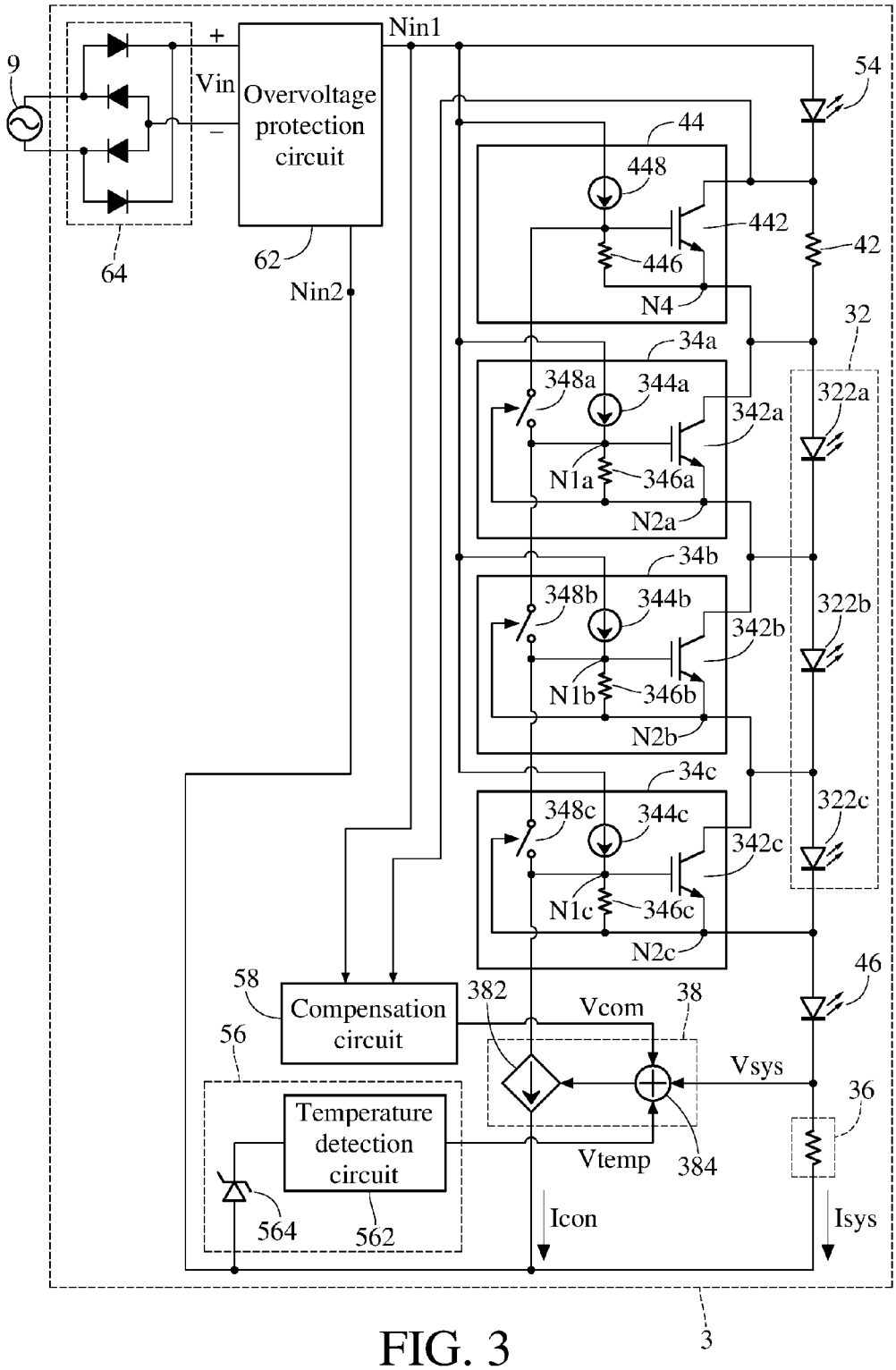
FIG. 3 is schematic circuit diagram of a light emitting device in another embodiment of the disclosure.

Please refer to FIG. 3 to illustrate another embodiment of the light emitting device. FIG. 3 is schematic circuit diagram of a light emitting device in another embodiment of the disclosure. As compared to the previous embodiment, a light emitting device 3 with one or more low voltage-endurance components further includes a second resistor 42, a second control circuit 44, a second light emitting diode 46, a third light emitting diode 54, a temperature detection circuit 56, a compensation circuit 58, an overvoltage protection circuit 62 and a rectification circuit 64. In addition to a voltage-controlled current source 382, the current control circuit 38 also includes a voltage adder 384. Note that in practice, only a part of the above components may be included in the light emitting device 3, and it is not necessary for the light emitting device 3 to use all of the above components for its normal operation. In this embodiment, the second control circuit 44 has a structure similar to the structure constituted by the first control circuits 34*a*~34*c*, so only the main part of the second control circuit 44 will be described later but the other part of the second control circuit 44 will not described.

Following the previous description, the second resistor 42 has two ends respectively coupled to the light emitting diode string 32 and the node of the input voltage Vin. The second control circuit 44 is coupled to a first light emitting diode 322*a*. The second control circuit 44 includes a third switch 442 connected to the second resistor 42 in parallel. The second light emitting diode 46 has two ends respectively connected to the light emitting diode string 32 and the detection circuit 36. The third light emitting diode 54 has two ends respectively connected to the node of the input voltage Vin and the second resistor 42. The temperature detection circuit 56 has two ends respectively coupled to the voltage adder 384 and the node of the input voltage Vin. The compensation circuit 58 is connected to the third light emitting diode 54 in parallel and is coupled to the voltage adder 384. The voltage adder 384 is coupled to the voltage-controlled current source 382. The overvoltage protection circuit 62 is coupled to the node of the input voltage Vin. The rectification circuit 64 is coupled to an AC power source 9 to produce the input voltage Vin. The rectification circuit 64 is, for example, a bridge rectifier, a rectification-boost circuit or a rectification-buck circuit.

Figure 4:
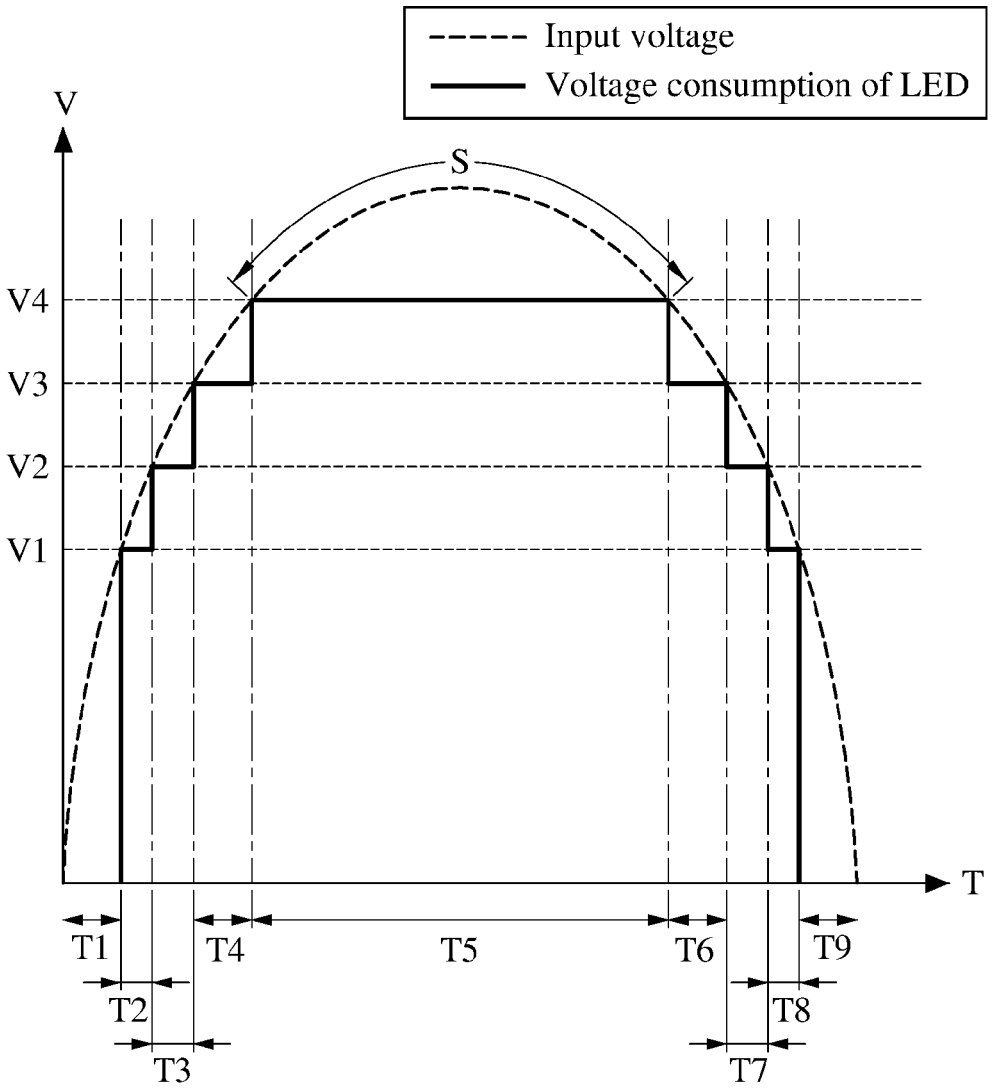
FIG. 4 is a schematic diagram of the input voltage of the light emitting device versus the voltage consumption of the light emitting diode string in an embodiment of the disclosure.

Please refer to FIG. 4 to illustrate how the light emitting device 3 emits light. FIG. 4 is a schematic diagram of the input voltage of the light emitting device versus the voltage consumption of the light emitting diode string in an embodiment of the disclosure, where the horizontal axis represents time, and the vertical axis represents voltage potential. In this embodiment, the input voltage Vin is exemplified by a DC sine-wave voltage produced by the full-wave rectification, but in practice, the input voltage Vin is not limited thereto. In FIG. 4, the dotted line represents a voltage waveform of the input voltage Vin during a cycle, and the solid lines represent voltages consumed by the first light emitting diodes 322*a*~322*c*, the second light emitting diode 46 and the third light emitting diode 54, respectively. FIG. 4 also presents a first time period T1 to a ninth time period T9 and a first voltage potential V1 to a fourth voltage potential V4.

During the first time period T1, the potential of the input voltage Vin is smaller than the first voltage potential V1, and all light emitting diodes do not emit light. During the second time period T2, the potential of the input voltage Vin is larger than the first voltage potential V1 but smaller than the second voltage potential V2, and the second light emitting diode 46 and the third light emitting diode 54 are turned on to emit light. During the third time period T3, the potential of the input voltage Vin is larger than the second voltage potential V2 but smaller than the third voltage potential V3, and the first light emitting diode 322*c* is turned on to emit light.

Then, during the fourth time period T4 and the fifth time period T5, the potential of the input voltage Vin progressively becomes larger than the third voltage potential V3 and then the fourth voltage potential V4, so the first light emitting diodes 322*b* and 322*a* are turned on in turn. During the fifth time period T5, the second control circuit 44 does not enable its related bypass current path, so the current Isys can flow through the second resistor 42. Herein, the second resistor 42 is used to consume the superfluous voltage energy corresponding to the curve S shown in FIG. 4, to protect the first light emitting diodes 322*a*~322*c*, the second light emitting diode 46 and the third light emitting diode 54. During the sixth time period T6 to the ninth time period T9, the input voltage Vin progressively decreases, the light emitting diodes are turned off in an order reverse to the previously-described order.

In view of FIG. 2 to FIG. 4, the luminous period of the second light emitting diode 46 and the luminous period of the third light emitting diode 54 cover the luminous periods of the first light emitting diodes 322*a*~322*c*. In other words, the second light emitting diode 46 and the third light emitting diode 54 are turned on earlier than the first light emitting diodes 322*a*~322*c* and are turned off later than the first light emitting diodes 322*a*~322*c*. Therefore, during most of a cycle of the input voltage Vin, the second light emitting diode 46 and the third light emitting diode 54 continuously emit light. Moreover, the amount of the second light emitting diode 46 and the amount of the third light emitting diode 54 are not limited to one. A person of ordinary skill in the art can in view of the disclosure, design a ratio among the amounts of first light emitting diodes 322*a*~322*c*, the amount of the second light emitting diode 46 and the amount of the third light emitting diode 54 according to a variety of actual requirements, to optimize the power consumption and efficiency of the light emitting device 3 or achieve a desired flicker index.

Figure 5A:
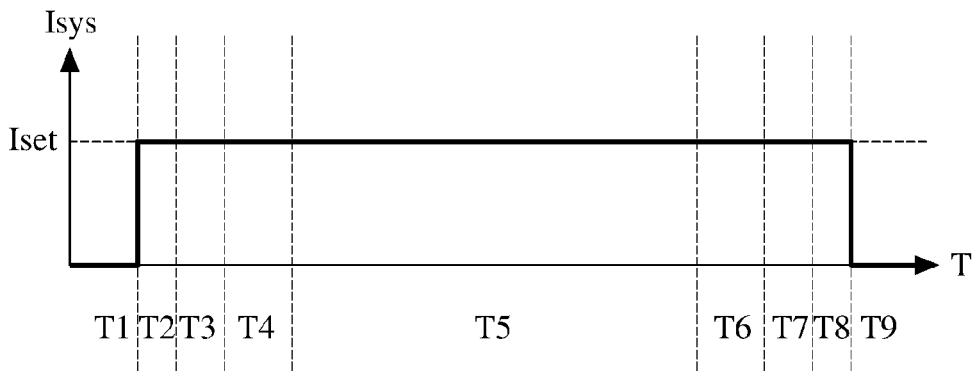
FIG. 5A is a schematic diagram of time versus an ideal current flowing through the light emitting diode string in FIG. 2.
Figure 5B:
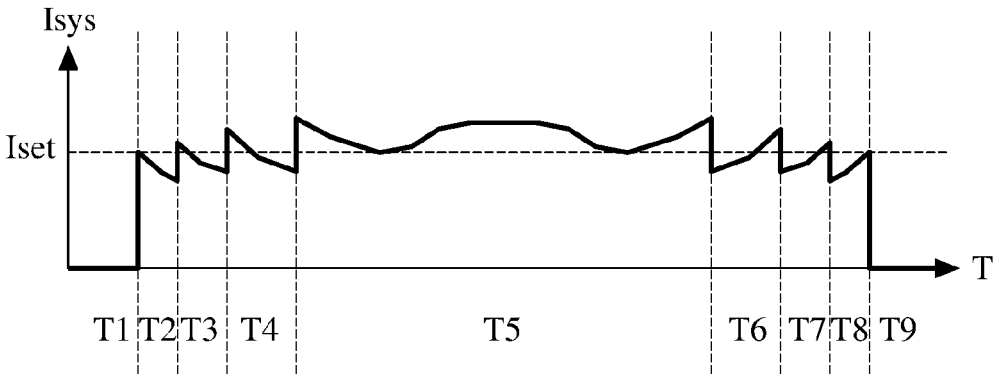
FIG. 5B is a schematic diagram of time versus a practical current flowing through the light emitting diode string in FIG. 2.
Figure 6A:
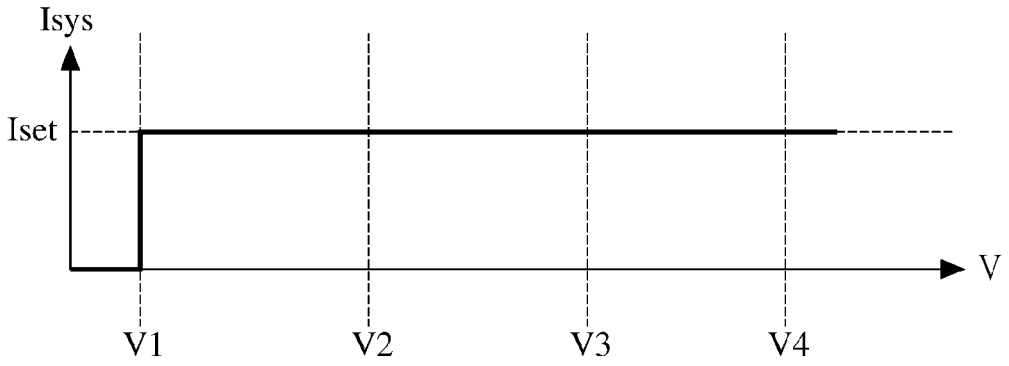
FIG. 6A is a schematic diagram of voltage versus an ideal current flowing through the light emitting diode string in FIG. 2.
Figure 6B:
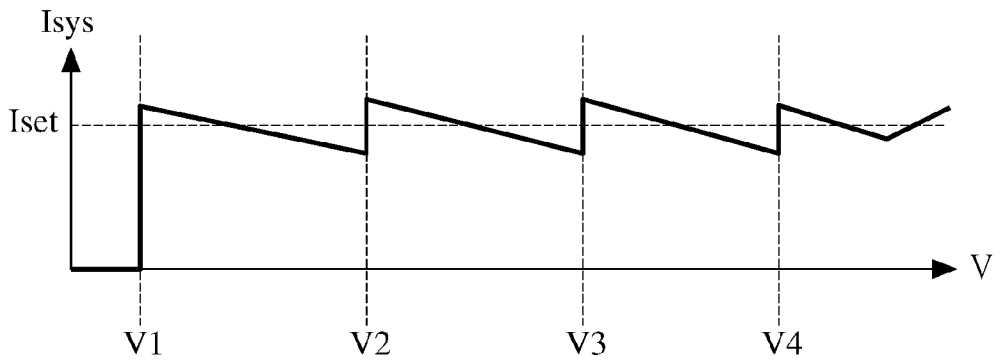
FIG. 6B is a schematic diagram of voltage versus a practical current flowing through the light emitting diode string in FIG. 2.

Please refer to FIGS. 5A, 5B, 6A and 6B. FIG. 5A is a schematic diagram of time versus an ideal current flowing through the light emitting diode string in FIG. 2, FIG. 5B is a schematic diagram of time versus a practical current flowing through the light emitting diode string in FIG. 2, FIG. 6A is a schematic diagram of voltage versus an ideal current flowing through the light emitting diode string in FIG. 2, and FIG. 6B is a schematic diagram of voltage versus a practical current flowing through the light emitting diode string in FIG. 2. In FIG. 5A and FIG. 5B, the horizontal axis represents time, and the vertical axis represents current. In FIG. 6A and FIG. 6B, the horizontal axis represents the potential of the input voltage, and the vertical axis represents the value of the current.

As shown in FIG. 5A and FIG. 6A, during the second time period T2 to the eighth time period T8, the current Isys should ideally be maintained at a specific value. Alternatively, even if the input voltage Vin changes, the current Isys should still be maintained at a specific value ideally. However, as shown in FIG. 5B and FIG. 6B, the current Isys, in fact, may change with time or the potential of the input voltage Vin. Specifically, the current Isys is varied with whether the first switches 342*a*~342*c* are turned on or not. In detail, during the second time period T2, the input voltage Vin is larger than the cut-in voltage of the second light emitting diode 46 and the cut-in voltage of the third light emitting diode 54, so the current Isys is produced to turn on the second light emitting diode 46 and the third light emitting diode 54. When the input voltage Vin progressively increases, more light emitting diodes are sequentially turned on, so the equivalent resistance of the flowing path of the current Isys increases with the increase of the input voltage Vin. Because of the increase of such an equivalent resistance of the flowing path, the current Isys, i.e. the division of the input voltage Vin by the equivalent resistance, is substantially maintained at a specific value.

More particularly, the current Isys has variations along the constant value axis represented by a preset current value Iset as shown in FIG. 5B or FIG. 6B, and the curve of the current Isys relative to the horizontal axis parameter in FIG. 5B is different from the curve of the current Isys relative to the horizontal axis parameter in FIG. 6B since the horizontal axis parameter in FIG. 5B is different from the horizontal axis parameter in FIG. 6B. Such variations of the current Isys can be reasonably deduced according to the description of the specification and figures and the circuit structure in the disclosure by a person of ordinary skill in the art, and thus, they are not described repeatedly. Basically, when the current control circuit 38, according to the current detection signal Vsys, determines that the current Isys is larger than a preset current value Iset, the current control circuit 38 will increase the current value of the control current Icon to turn on the next light emitting diode. Therefore, the current Isys increases to be slightly larger than the preset current value Iset to trigger the current control circuit 38. Then, when the next light emitting diode is turned on, the current Isys decreases to be smaller than the preset current value Iset. With the increase of the input voltage Vin, the current Isys progressively increases so that the light emitting device 3 repeats the aforementioned action.

Please refer to FIG. 3 again to introduce other elements in the light emitting device 3. The voltage adder 384 is applicable to add a temperature detection signal Vtemp and a compensation signal Vcom to the current detection signal Vsys. In the embodiment shown in FIG. 3, the voltage-controlled current source 382 adjusts the current value of the control current Icon according to such a current detection signal Vsys that has contained the temperature detection signal Vtemp and the compensation signal Vcom. The larger the voltage potential of the current detection signal Vsys, the larger the current value of the control current Icon; and the less the voltage potential of the current detection signal Vsys, the less the current value of the control current Icon. Therefore, the current control circuit 38 adjusts the current value of the control current Icon according to not only the current detection signal Vsys but also the temperature detection signal Vtemp and the compensation signal Vcom. In an embodiment, the current control circuit 38 adjusts the preset current value Iset according to the temperature detection signal Vtemp, so as to correct the voltage and current values that are drifting with the variations in the system temperature.

The temperature detection circuit 56 includes a temperature detection circuit 562 and a Zener diode 564. One end of the Zener diode 564 is coupled to the node of the input voltage Vin, and the temperature detection circuit 562 is coupled to the other end of the Zener diode 564 and the voltage adder 384. The temperature detection circuit 56 is applicable to detect the system temperature to produce the temperature detection signal Vtemp. When the system temperature is higher than a temperature threshold, the current control circuit 38 adjusts the current value of the control current Icon according to the temperature detection signal Vtemp, so as to control the first control circuits 34*a*~34*c* to selectively enable one or more bypass current paths.

The compensation circuit 58 is applicable to generate the compensation signal Vcom according to the voltage difference between two ends of the third light emitting diode 54. Specifically, the cut-in voltage of a light emitting diode is affected by the fabrication conditions of this light emitting diode, so the compensation circuit 58, according to the voltage difference between the two ends of the third light emitting diode 54, determines that the cut-in voltage of the third light emitting diode 54 is smaller than or larger than a predetermined cut-in voltage, and according to the determination, produces the compensation signal Vcom to drive the current control circuit 38 to adjust the current value of the control current Icon.

Figure 7:
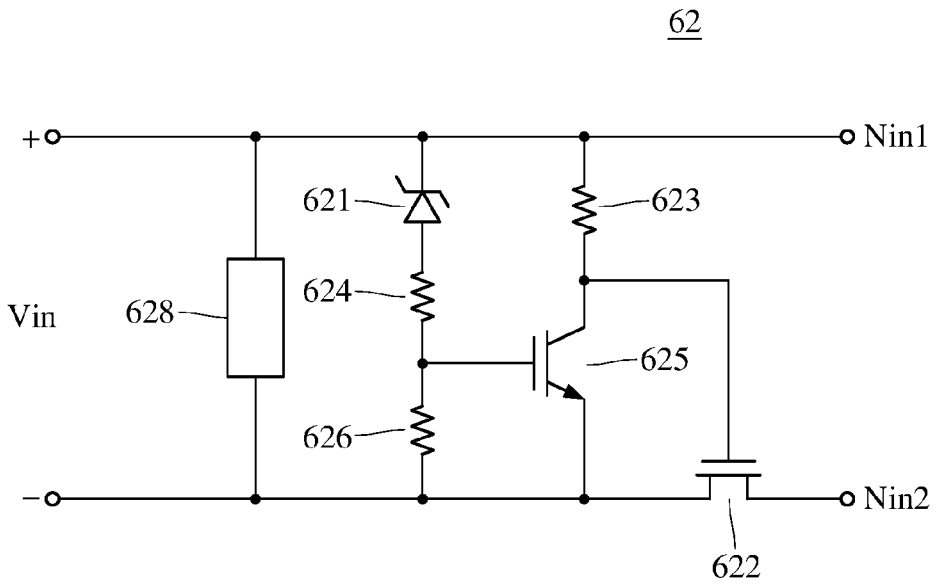
FIG. 7 is schematic circuit diagram of the overvoltage protection circuit in an embodiment of the disclosure.
Figure 8:
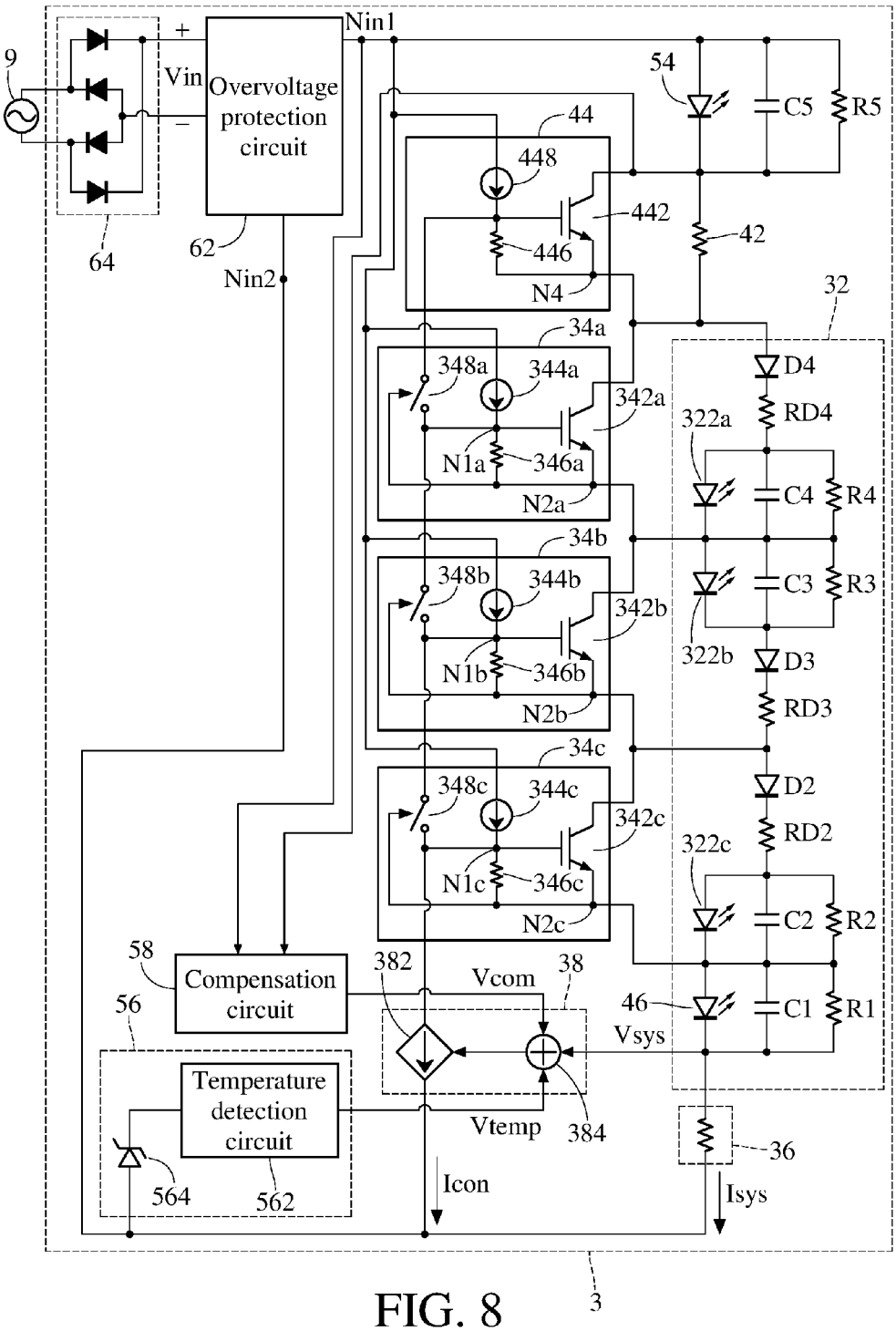
FIG. 8 is schematic circuit diagram of the light emitting device in another embodiment of the disclosure.

Please refer to FIG. 7 introduce an embodiment of the overvoltage protection circuit. FIG. 7 is schematic circuit diagram of the overvoltage protection circuit in an embodiment of the disclosure. The overvoltage protection circuit 62 includes a Zener diode 621, a first resistor 623, a second resistor 624, a third resistor 626, a third switch 622, a fourth switch 625 and an impedance 628, and the connections between these components are shown in FIG. 8. When the potential of the input voltage Vin is smaller than the sum of the breakdown voltage of the Zener diode 621 and the turn-on voltage of the fourth switch 625, the fourth switch 625 is turned off but the third switch 622 is turned on. Herein, the input voltage Vin is applied via a node Nin1 and a node Nin2 to the follow-up circuit so that the follow-up circuit could normally operate. When the potential of the input voltage Vin is larger than the sum of the breakdown voltage of the Zener diode 621 and the turn-on voltage of the fourth switch 625, the fourth switch 625 is turned on so that the third switch 622 is turned on. Herein, the input voltage Vin is not applied to the follow-up circuit. For example, the third switch 622 is an N-type metal-oxide-semiconductor field-effect transistor (MOSFET), the fourth switch 625 is a bipolar junction transistor (BJT), and the impedance 628 is a metal oxide varistor (MOV).

Please refer to FIG. 8. FIG. 8 is schematic circuit diagram of the light emitting device in another embodiment of the disclosure. In the embodiment shown in FIG. 8, a light emitting device 3' further includes capacitors C1~C5, resistors R1~R5 and RD2~RD4, and diodes D2~D4 as compared with the light emitting device 3 in FIG. 3.

The capacitor C1, the resistor R1 and the second light emitting diode 46 are connected in parallel. The capacitor C5, the resistor R5 and the third light emitting diode 54 are connected in parallel. Similarly, the capacitors C2~C4, the resistors R2~R4 and the first light emitting diodes 322*a*~322*c* are connected in parallel, respectively; in detail, the capacitor C2, the resistor R2 and the first light emitting diode 322*c* are connected in parallel, the capacitor C3, the resistor R3 and the first light emitting diode 322*b* are connected in parallel, and the capacitor C4, the resistor R4 and the first light emitting diode 322*a* are connected in parallel. At another aspect, the capacitors C1~C5, the resistors R1~R5 and the related light emitting diodes are respectively connected in parallel to constitute a plurality of light emitting units electrically connected. As an example, the capacitor C5, the resistor R5 and the third light emitting diode 54 constitute a light emitting unit. A person of ordinary skill in the art can deduce other light emitting units by analogy.

The resistors RD2~RD4 and the diodes D2~D4 are respectively connected in series to constitute series circuits each connected to related one of the above light emitting units in series. At an aspect, the resistors RD2~RD4 and the diodes D2~D4 each connected to related one of the resistors RD2~RD4 in series constitute a plurality of protection units. For example, the resistor RD2 is connected to the diode D2 in series to constitute a protection unit. A protection unit is connected to a light emitting unit in series. The connections among the resistors RD2~RD4 and the diodes D2~D4 in FIG. 7 are an exemplary embodiment, but not used to limit the order or method of connecting the protection units and the light emitting units in series.

The capacitors C1~C5 are used to ease the flickers occurring to the first light emitting diodes 322*a*~322*c*, the second light emitting diode 46 and the third light emitting diode 54, respectively. Specifically, as described above, when the input voltage Vin progressively increases to be larger than or substantially equal to the sum of the turn-on voltages of the second light emitting diode 46 and the third light emitting diode 54, the second light emitting diode 46 and the third light emitting diode 54 are turned on and the capacitors C1 and C5 respectively store the energy in the turn-on voltage of the second light emitting diode 46 and the energy in the turn-on voltage of the third light emitting diode 54.

When the input voltage Vin is larger than or substantially equal to the sum of the turn-on voltages of the diodes 322*a*~322*c*, 46 and 54, all the first light emitting diodes 322*a*~322*c*, the second light emitting diode 46 and the third light emitting diode 54 are turned on and the capacitors C1~C5 respectively store the relative energy in the turn-on voltages of the diodes 322*a*~322*c*, 46 and 54 respectively connected to the capacitors C1~C5 in parallel.

When the input voltage Vin progressively decreases to be smaller than the sum of the turn-on voltages of the first light emitting diodes 322*a*~322*c*, the second light emitting diode 46 and the third light emitting diode 54, the first switch 342*a* is turned on to enable a bypass current path to the light emitting unit constituted by the first light emitting diode 322*a*, the capacitor C4 and the resistor R4. Therefore, the capacitor C4 provides electric power to the first light emitting diode 322*a* to prevent the first light emitting diode 322*a* from immediately stopping emitting light when the first switch 342*a* enables its related bypass current path. Likewise, the capacitors C1~C3 and C5 should also do the similar operations and have the similar functions, and they will not repeated hereinafter.

Additionally, the capacitors C1~C5 are capable of maintaining a constant voltage potential to prevent the voltage difference between the two ends of each of the diodes 322*a*~322*c*, 46 and 54 from fast increasing or decreasing with the turn-on of the switch 342*a*, 342*b*, 342*c* or 442 and further prevent the luminous brightness of each of the diodes 322*a*~322*c*, 46 and 54 from be directly affected. The resistors R1~R5 are used to consume the surplus electric energy stored in the capacitors C1~C5.

The diodes D2~D4 are used to prevent the capacitors C2~C4 from discharging toward the bypass paths enabled by the first switches 342*a*, 342*b* and 342*c*, respectively. The resistors RD2~RD4 are used to prevent the above electric components from being damaged by a large current when the power source is just turned on.

As set forth above, the disclosure provides a light emitting device that detects a current flowing through the light emitting diode string and controls a controllable current source according to the detection result. The controllable current source further drives one or more control modules corresponding to one or more light emitting diodes to selectively enable one or more bypass current paths to one or more related light emitting diodes, so the light emitting diodes in the light emitting diode string are turned on in an order from a node of low voltage potential to a node of high voltage potential. As compared to the conventional method to turn on a light emitting diode string, the voltage difference between the two ends of each switch in the light emitting device in the disclosure is lower, so low voltage-endurance components could be used in the light emitting device. Therefore, the manufacturing cost of the light emitting device may be reduced.

What is claimed is:

1. A light emitting device with one or more low voltage-endurance components, the light emitting device comprising:

a light emitting diode string comprising M first light emitting diodes connected in series, and one end of the light emitting diode string coupled to a node of an input voltage;

M first control circuits, each of which comprises a first switch that is connected to corresponding one of the M first light emitting diodes in parallel and configured to selectively enable a bypass current path;

a detection circuit configured to detect a current, flowing through one or more of the M first light emitting diodes, to produce a current detection signal when the input voltage is applied to the light emitting diode string;

a current control circuit coupled to the M-th first control circuit of the M first control circuits and the detection circuit and configured to in response to the current detection signal control the M-th first control circuit of the M first control circuits to provide a preset voltage to the first switch in the M-th first control circuit of the M first control circuits, so as to electively enable the bypass current path;

wherein when the first switch in the M-th first control circuit of the M first control circuits does not enable the bypass current path, in response to a potential of the input voltage the M-th first control circuit of the M first control circuits further selectively controls the (M−1)th first control circuit of the M first control circuits to provide the preset voltage to the first switch in the (M−1)th first control circuit of the M first control circuits, and M is a positive integer larger than 1.

2. The light emitting device according to claim 1, wherein when the first switch in the i-th first control circuit of the M first control circuits does not enable the bypass current path, the i-th first control circuit of the M first control circuits further in response to the potential of the input voltage selectively controls the (i−1)th first control circuit of the M first control circuits to provide the preset voltage to the first switch in the (i−1)th first control circuit of the M first control circuits, and i is a positive integer larger than 1 but smaller than or equal to M.

3. The light emitting device according to claim 2, wherein the i-th first control circuit of the M first control circuits further comprises:

a constant current source having two ends respectively coupled to the input voltage and a first node;

a first resistor having two ends respectively coupled to the first node and a second node; and a second switch;

wherein the first switch in the i-th first control circuit of the M first control circuits is coupled to the second node of the i-th first control circuit of the M first control circuits and the second node of the (i−1)th first control circuit of the M first control circuits and in response to a potential of the first node of the i-th first control circuit of the M first control circuits, decides whether to electrically connect the second node of the (i−1)th first control circuit of the M first control circuits to the second node of the i-th first control circuit of the M first control circuits; and the second switch of the i-th first control circuit of the M first control circuits is coupled to the first node of the i-th first control circuit of the M first control circuits and the first node of the (i−1)th first control circuit of the M first control circuits and in response to a potential of the second node of the i-th first control circuit of the M first control circuits, decides whether to electrically connect the first node of the (i−1)th first control circuit of the M first control circuits to the first node of the i-th first control circuit of the M first control circuits.

4. The light emitting device according to claim 3, wherein when the potential of the second node of the i-th first control circuit of the M first control circuits is larger than a related threshold, the second switch in the i-th first control circuit of the M first control circuits is turned on and the current control circuit, in response to the current detection signal, causes that the output current of the constant current source in the (i−1)th first control circuit of the M first control circuits flows to the current control circuit after flowing through the second switch in the i-th first control circuit of the M first control circuits; and the potential of the second node of each of the M first control circuits is related to the input voltage.

5. The light emitting device according to claim 3, wherein when a potential of the second node of the i-th first control circuit of the M first control circuits is smaller than or substantially equal to a related threshold, the second switch in the i-th first control circuit of the M first control circuits is turned off, an output current of the constant current source in the (i−1)th first control circuit of the M first control circuits flows through the first resistor in the (i−1)th first control circuit of the M first control circuits so the preset voltage is applied to the first node of the (i−1)th first control circuit of the M first control circuits.

6. The light emitting device according to claim 1, further comprising:

a second resistor having two ends respectively coupled to the light emitting diode string and the input voltage; and a second control circuit coupled to the first one of the M first light emitting diodes and comprising a third switch connected to the second resistor in parallel, wherein when the first one of the M first light emitting diodes does not emit light, the second control circuit turns on the third switch to enable the bypass current path for the second resistor.

7. The light emitting device according to claim 1, further comprising:

a second light emitting diode having two ends respectively connected to the light emitting diode string and the detection circuit.

8. The light emitting device according to claim 1, further comprising:

a third light emitting diode having two ends respectively connected to the node of the input voltage and the light emitting diode string.

9. The light emitting device according to claim 8, further comprising:

a compensation circuit coupled to the third light emitting diode and the current control circuit and configured to generate a compensation signal in response to a voltage difference between two ends of the third light emitting diode, wherein in response to the compensation signal, the current control circuit further controls the M first control circuits to selectively enable the bypass current path.

10. The light emitting device according to claim 1, further comprising:

a temperature detection circuit coupled to the current control circuit and configured to detect a system temperature and generate a temperature detection signal according to the system temperature, wherein, when the system temperature is higher than a temperature threshold, the current control circuit further controls the M first control circuits to enable the bypass current path in response to the temperature detection signal.

11. The light emitting device according to claim 1, further comprising:

an overvoltage protection circuit coupled to the node of the input voltage, wherein, when the input voltage is larger than a voltage threshold, the overvoltage protection circuit set the input voltage to be at a low voltage potential.

12. A light emitting device with one or more low voltage-endurance components, the light emitting device comprising:

a light emitting diode string comprising M first light emitting diodes connected in series;

a second light emitting diode directly connected to the M-th first light emitting diode of the M first light emitting diodes;

a third light emitting diode having two ends that are directly connected to the first one of the M first light emitting diodes and a node of an input voltage, respectively; and M first control circuits, each of which comprises a first switch connected to corresponding one of the M first light emitting diodes and configured to selectively enable a bypass current path in response to a command of the corresponding first control circuit;

wherein when the input voltage is larger than a first threshold, the second light emitting diode and the third light emitting diode simultaneously emit light;

when the input voltage is larger than a second threshold larger than the first threshold, the M first control circuits respectively disable the bypass current paths sequentially so that the M first light emitting diodes sequentially emit light; and M is a positive integer larger than 1.

13. The light emitting device according to claim 12, further comprising:

a detection circuit configured to detect a current, flowing through one or more of the M first light emitting diodes, to produce a current detection signal when the input voltage is applied to the light emitting diode string; and a current control circuit coupled to the M-th first control circuit of the M first control circuits and the detection circuit and configured to in response to the current detection signal, control the M-th first control circuit of the M first control circuits whether to provide a preset voltage to the first switch in the M-th first control circuit of the M first control circuits, so as to selectively enable the bypass current path;

wherein when the first switch in the M-th first control circuit of the M first control circuits does not enable the bypass current path, the M-th first control circuit of the M first control circuits selectively controls the (M−1)th first control circuit of the M first control circuits according to a potential of the input voltage to selectively provide the preset voltage to the first switch in the (M−1)th first control circuit of the M first control circuits, and M is a positive integer larger than 1.

14. The light emitting device according to claim 13, wherein when the first switch in the i-th first control circuit of the M first control circuits does not enable the bypass current path, the i-th first control circuit of the M first control circuits selectively controls the (i−1)th first control circuit of the M first control circuits to provide the preset voltage to the first switch in the (i−1)th first control circuit of the M first control circuits according to the potential of the input voltage, and i is a positive integer larger than 1 but not larger than M.

15. The light emitting device according to claim 14, wherein the i-th first control circuit of the M first control circuits further comprises:

a constant current source having two ends respectively coupled to the node of the input voltage and a first node;

a first resistor having two ends respectively coupled to the first node and a second node; and a second switch;

wherein the first switch in the i-th first control circuit of the M first control circuits is coupled to the second node of the i-th first control circuit of the M first control circuits and the second node of the (i−1)th first control circuit of the M first control circuits and is controllable in response to the potential of the first node of the i-th first control circuit of the M first control circuits to electrically connect the second node of the (i−1)th first control circuit of the M first control circuits to the second node of the i-th first control circuit of the M first control circuits selectively;

the second switch in the i-th first control circuit of the M first control circuits is coupled to the first node of the i-th first control circuit of the M first control circuits and the first node of the (i−1)th first control circuit of the M first control circuits and is controlled by a potential of the second node of the i-th first control circuit of the M first control circuits to selectively and electrically connect the first node of the (i−1)th first control circuit of the M first control circuits to the first node of the i-th first control circuit of the M first control circuits.

16. The light emitting device according to claim 15, wherein when the potential of the second node of the i-th first control circuit of the M first control circuits is larger than a related threshold, the second switch in the i-th first control circuit of the M first control circuits is turned on and in response to the current detection signal, the current control circuit causes that an output current of the constant current source in the (i−1)th first control circuit of the M first control circuits flows to the current control circuit after flowing through the second switch in the i-th first control circuit of the M first control circuits; and the potential of the second node of each of the M first control circuits is related to the input voltage.

17. The light emitting device according to claim 15, wherein when the potential of the second node of the i-th first control circuit of the M first control circuits is not larger than the related threshold, the second switch in the i-th first control circuit of the M first control circuits is turned off so that an output current of the constant current source in the (i−1)th first control circuit of the M first control circuits flows through the first resistor in the (i−1)th first control circuit of the M first control circuits to provide the preset voltage to the first node of the (i−1)th first control circuit of the M first control circuits.

18. The light emitting device according to claim 12, further comprising:

a second resistor having two ends respectively coupled to the light emitting diode string and the node of the input voltage; and a second control circuit coupled to the first one of the M first light emitting diodes and comprising a third switch connected to the second resistor in parallel, wherein when the first one of the M first light emitting diodes does not emit light, the second control circuit turns on the third switch to enable the bypass current path for the second resistor.

19. The light emitting device according to claim 12, further comprising:

a compensation circuit coupled to the third light emitting diode and the current control circuit and configured to generate a compensation signal in response to a voltage difference between two ends of the third light emitting diode, wherein in response to the compensation signal, the current control circuit further controls each of the M first control circuits to selectively enable the bypass current path.

20. The light emitting device according to claim 12, further comprising:

a temperature detection circuit coupled to the current control circuit and configured to detect a system temperature and produce a temperature detection signal according to the system temperature, wherein when the system temperature is higher than a temperature threshold, the current control circuit further controls each of the M first control circuits to selectively enable the bypass current path according to the temperature detection signal.

21. The light emitting device according to claim 12, further comprising:

an overvoltage protection circuit coupled to the node of the input voltage, wherein when the input voltage is higher than a threshold, the overvoltage protection circuit sets the input voltage to be at a low voltage potential.

* * * * *